US012578133B2

(12) United States Patent
Furberg et al.

(10) Patent No.: US 12,578,133 B2
(45) Date of Patent: Mar. 17, 2026

(54) COOLING SYSTEM CONTROL

(71) Applicant: ELECTROLUX APPLIANCES AKTIEBOLAG, Stockholm (SE)

(72) Inventors: Richard Furberg, Stockholm (SE); Andreas Stefan Aschan, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 216 days.

(21) Appl. No.: 18/288,305

(22) PCT Filed: Apr. 7, 2022

(86) PCT No.: PCT/EP2022/059198

§ 371 (c)(1),
(2) Date: Oct. 25, 2023

(87) PCT Pub. No.: WO2022/228850

PCT Pub. Date: Nov. 3, 2022

(65) Prior Publication Data

US 2024/0219090 A1 Jul. 4, 2024

(30) Foreign Application Priority Data

Apr. 26, 2021 (EP) ..... 21170361

(51) Int. Cl.
*F25B 49/02* (2006.01)
*F25B 5/02* (2006.01)
*F25B 41/24* (2021.01)

(52) U.S. Cl.
CPC ..... *F25B 49/02* (2013.01); *F25B 5/02* (2013.01); *F25B 41/24* (2021.01);
(Continued)

(58) Field of Classification Search
CPC ..... F25B 2500/26; F25B 2500/27; F25B 2600/01; F25B 2600/0253; F25B 2600/23;
(Continued)

(56) References Cited

U.S. PATENT DOCUMENTS 5,251,455 A 10/1993 Cur et al.
8,161,763 B2 4/2012 Yun et al.
(Continued)

FOREIGN PATENT DOCUMENTS

WO 2016198084 12/2016

OTHER PUBLICATIONS

International Search Report for PCT/EP2022/059198, dated Jun. 20, 2022, 2 pages.

*Primary Examiner* — Henry T Crenshaw
(74) *Attorney, Agent, or Firm* — Chrisman Gallo Tochtrop LLC

(57) ABSTRACT

A cooling system includes a compressor, a condenser, and an evaporator where a refrigerant is circulated, and a valve interconnected in the flow of the refrigerant from the condenser to the evaporator. The valve is configured to enter a first, open, state when the compressor is in an on-phase and to enter a second, closed, state when the compressor is in an off state by a controller. The controller controls the valve to operate in accordance with opening the valve at a first variable time period before the compressor is switched to an on-phase; where the first variable time period is set in response to an external parameter obtained by the controller, and/or closing the valve at a second variable time period before the compressor is switched to an off-phase, where the second variable time period is set in response to an external parameter obtained by the controller.

10 Claims, 6 Drawing Sheets

(52) U.S. Cl.
CPC ..... *F25B 2500/26* (2013.01); *F25B 2500/27* (2013.01); *F25B 2600/01* (2013.01); *F25B 2600/0253* (2013.01); *F25B 2600/2519* (2013.01); *F25B 2700/2106* (2013.01)

(58) Field of Classification Search
CPC ..... F25B 2600/2519; F25B 2700/2106; F25B 41/24; F25B 49/02; F25B 5/02
See application file for complete search history.

(56) References Cited

U.S. PATENT DOCUMENTS

| | | | | |
|---|---|---|---|---|
| 10,539,431 | B2 | 1/2020 | Liu et al. | |
| 2018/0142930 | A1* | 5/2018 | Aschan | F25B 49/02 |
| 2018/0187934 | A1* | 7/2018 | Viet | F25B 40/00 |
| 2019/0242604 | A1* | 8/2019 | Wan | F25B 13/00 |
| 2019/0360725 | A1* | 11/2019 | Kondou | F25B 1/005 |
| 2020/0171916 | A1* | 6/2020 | Shrivastava | B60H 1/00807 |
| 2020/0191423 | A1* | 6/2020 | Sun | G05B 15/02 |
| 2022/0282724 | A1* | 9/2022 | Vansweevelt | G01M 3/00 |

* cited by examiner

COOLING SYSTEM CONTROL

TECHNICAL FIELD

The present disclosure relates to a cooling system and a method for control thereof. In particular the present disclosure relates to a cooling system having a valve that can be closed on the path between a condenser and an evaporator of the cooling system.

BACKGROUND

Most compressor cooling systems used in today's household refrigerators use a capillary tube to reduce the pressure of the refrigerant flowing from condenser to evaporator. Further, many of these cooling systems do not run continuously, but turn on and off in cycles. There is then a compressor on-phase followed by a compressor off-phase. In these systems there are typically two kinds of efficiency losses.

Efficiency losses related to refrigerant vapor that flow from condenser to evaporator, through the capillary tube during the compressor off-phase. Since nothing stops the vapor from flowing through the capillary tube during compressor off time, this will happen until the pressures are equalized.

Efficiency losses related to that the evaporator and condenser pressures vary during the compressor on-phase. The refrigerant mass flow rate through the capillary tube is a function of evaporator and condenser pressure. When the pressure difference between evaporator and condenser is high the flow rate is high, and vice versa. This means, unfortunately, that the mass flow rate through the capillary tube does not always correspond to the flow rate that would be optimum for the system. At the start of the compressor on-phase, the pressure difference is lower than at the end of the compressor on phase. This means that the refrigerant flow rate through the capillary tube is lower at the start than at the end of the compressor on-phase. Unfortunately, the flow rate through the capillary tube that would be optimum for the system, vary in the opposite way. In other words, it would typically be better with a higher flow rate at the start than at the end of the compressor on-phase.

To decrease losses resulting from migration of refrigerant during compressor off-phase, an open/close valve can be installed in series with the capillary tube, to stop the refrigerant flow through capillary tube during the time that the compressor is in the off-phase, i.e., when the compressor is not running. In such a system a refrigeration system may use an open/close valve located on the path from the condenser to the evaporator to prevent refrigerant migration from the condenser to the evaporator of the refrigeration system during a compressor off-phase. The valve is set to a closed state during the compressor off-phase and set to an open state during the compressor on-phase. Hereby energy loss resulting from refrigerant migration can be eliminated or at least reduced.

A refrigeration/freezer system as described above is depicted in FIG. 1*a*. Further, in some refrigeration systems, the use of a valve that is in a closed state during a compressor off period results in that the compressor will have to start against a pressure difference between the condenser and evaporator. In order to reduce the need for an increased start torque the valve can be opened a predetermined period before the start of the compressor. This can equalize the pressure difference and may thereby reduce the required start torque. Also, the pre-opening of the valve can improve the energy efficiency of the cooling system. Such a refrigeration system is described in the U.S. Pat. No. 8,161,763.

To improve the performance, the valve can be closed before the compressor is switched to an off-phase as is described in U.S. Pat. No. 10,697,679.

There is a constant desire to improve the performance in a refrigerant system and to provide more efficient refrigeration system. Hence, there is a need for an improved refrigerator apparatus and to a cooling system used in a refrigerator.

SUMMARY

It is an object of the present invention to provide an improved refrigerator apparatus.

This object and/or others are obtained by the cooling system, the refrigerator/freezer as set out in the appended claims.

As has been realized by the inventors, by opening the valve in the path between the condenser and evaporator a small time period before the compressor on-phase and or closing the valve a small time period before the compressor off-phase it is possible to achieve an increased fluid mass flow during the first part of the compressor on-phase and a decreased fluid mass flow during the last part of the compressor on-phase. Hereby energy can be saved in that the mass flow is better fitted to the optimal working conditions of the capillary tube. However, it has further been realized that the timing of the opening and/closing of the valve is important in terms of achieving a high energy efficiency.

Thus, energy savings can be improved by determining an optimal timing. Further, it has ben realized that the optimal time can be determined by taking one or more external parameters into account when determining the opening time and the closing time of the valve.

In cooling systems with multiple evaporators and where the refrigerant is only allowed to circulate through one evaporator at the time (or in no evaporator) the energy savings can be expected to be higher. Such a system can for example be used in a combined freezer refrigerator where one evaporator is arranged for the freezer cabinet and one evaporator is arranged for the refrigerator cabinet and where the different evaporators are arranged in parallel. This is because in cooling systems with parallel evaporators, the refrigerator evaporator is typically totally empty on refrigerant after running the freezer evaporator, and vice versa. In such a scenario, an opening of the valve before the compressor starts, is expected to significantly improve efficiency of the evaporator during the first part of the on-phase of the compressor cycle.

In accordance with one embodiment a cooling system comprising a compressor, a condenser and an evaporator wherein a refrigerant is circulated is provided. The cooling system further comprises a valve interconnected in the flow of the refrigerant from the condenser to the evaporator. The valve is operatively controlled to a first, open, state when the compressor is in an on-phase and to a second, closed, state when the compressor is in an off state by a controller. The controller is adapted to control the valve to operate in accordance with at least one of:

opening the valve a first variable time period before the compressor is switched to an on-phase; where the first variable time period is set in response to an external parameter obtained by the controller, and/or closing the valve a second variable time period before the compressor is switched to an off-phase, where the second variable time period is set in response to an external parameter obtained by the controller.

Hereby, the times for opening/closing the valve in conjunction with starting/stopping the compressor can be made to vary in response to an external parameter. This can improve the energy efficiency of the cooling system because the optimal time for the opening/closing time for the valve has been found to vary with external parameters.

In accordance with another aspect of the invention the controller is adapted to, when the compressor is in an off state, move a piston of the compressor backwards against the normal direction of operation of the piston. Hereby an easier start of the compressor can be obtained since the piston then will be moved to a position that is better or at least not very bad in terms of starting conditions. As a result, the start will always take place under good or at least acceptable start conditions.

In accordance with one embodiment the controller is adapted to move the piston with a pre-determined force and or during a predetermined time. Hereby a more precise control of the piston position can be achieved and the starting conditions made better.

Further, when controlling the opening/closing time of the valve, the external parameter can in accordance with some embodiments be selected to be the ambient temperature. The ambient temperature has been found to impact the optimum opening/closing times of the valve to a large extent and the energy efficiency can therefore be greatly improved. For example, when the ambient temperature above a standard temperature, a shorter preopening time for the valve can be set or, when the ambient temperature is higher than a standard ambient temperature, increase the closing time such that the valve is closed longer before the compressor is switched to an off-phase.

In accordance with some embodiments other external parameters can be used instead of or as a supplement to the ambient temperature. For example, the external parameter can comprise at least one of: a condenser temperature, a refrigerator temperature, a refrigerator evaporator temperature, and a refrigerator set point temperature.

In accordance with some embodiments, the cooling system comprises at least a first evaporator and a second evaporator and wherein the first evaporator is connected in parallel with the second evaporator. A correct opening/closing time for the valve for a cooling system with such a configuration of multiple evaporators can save a large amount of energy.

In accordance with some embodiments, when the cooling system comprises a compressor driven at a variable speed, the speed of the compressor is varied based on at least one of said external parameters. Hereby an improved energy use can be obtained.

The invention also extends to a refrigerator comprising a cooling system according to the above.

BRIEF DESCRIPTION OF THE DRAWINGS

The present invention will now be described in more detail by way of non-limiting examples and with reference to the accompanying drawings, in which.

DETAILED DESCRIPTION

Figure 1A:
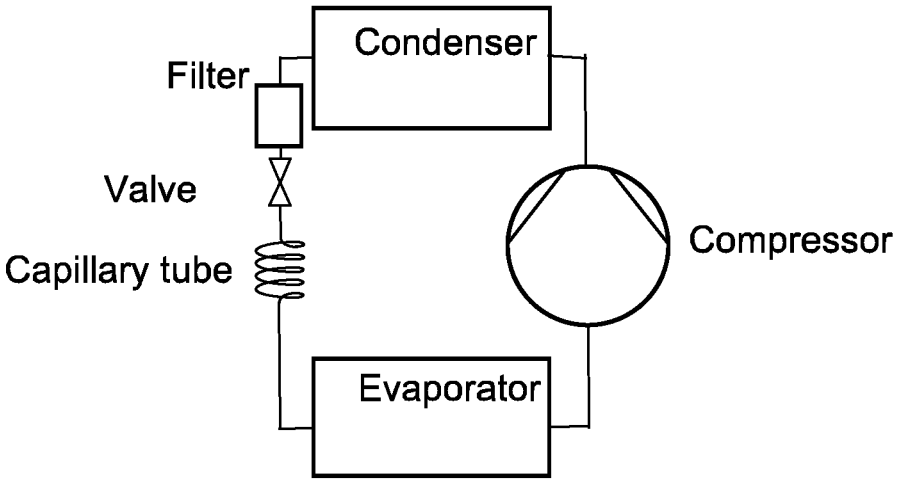
FIG. 1*a* illustrates a conventional refrigerator system.
Figure 1B:
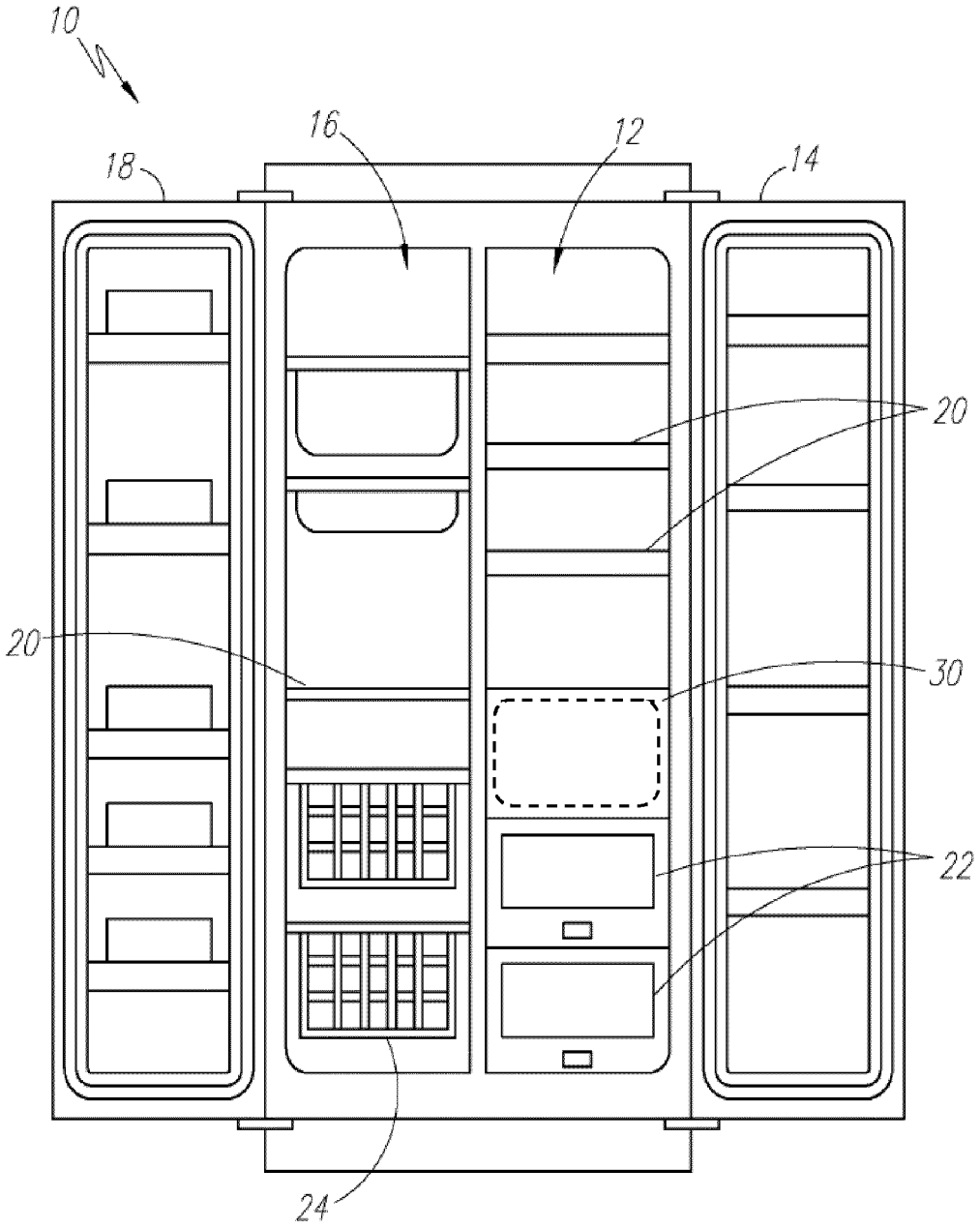
FIG. 1*b* illustrates a refrigerator.

In FIG. 1*b*, a typical household refrigerator 10 comprising a fresh food compartment 12 and a freezer compartment 16. The exemplary refrigerator 10 in FIG. 1*b* is of the type known as side by side. However, the cooling system as described herein can be employed in any type of refrigerator such as a French door type, top freezer type, bottom freezer type, or any other type of refrigerator. A door 14, shown in FIG. 1*b* as open, is mounted to the refrigerator body by hinges and serves to close the front of the fresh food compartment 12 as well as provide access to the interior of the fresh food compartment. A door 18, shown in FIG. 1*b* as open, also is mounted to the refrigerator body by hinges and serves to close the front of the freezer compartment 16 as well as provide access to the interior of the freezer compartment. The fresh food and freezer compartments can include a variety of shelves 20, closed drawers 22 and basket-like drawers 24 for storing articles of food and the like. Also, other configurations of the household refrigerator 10 can be envisaged depending on the type of refrigerator and to meet different needs. To cool the refrigerator a cooling system 30 is provided. An exemplary cooling system 30 will now be described in more detail with reference to the following Figures.

Figure 2:
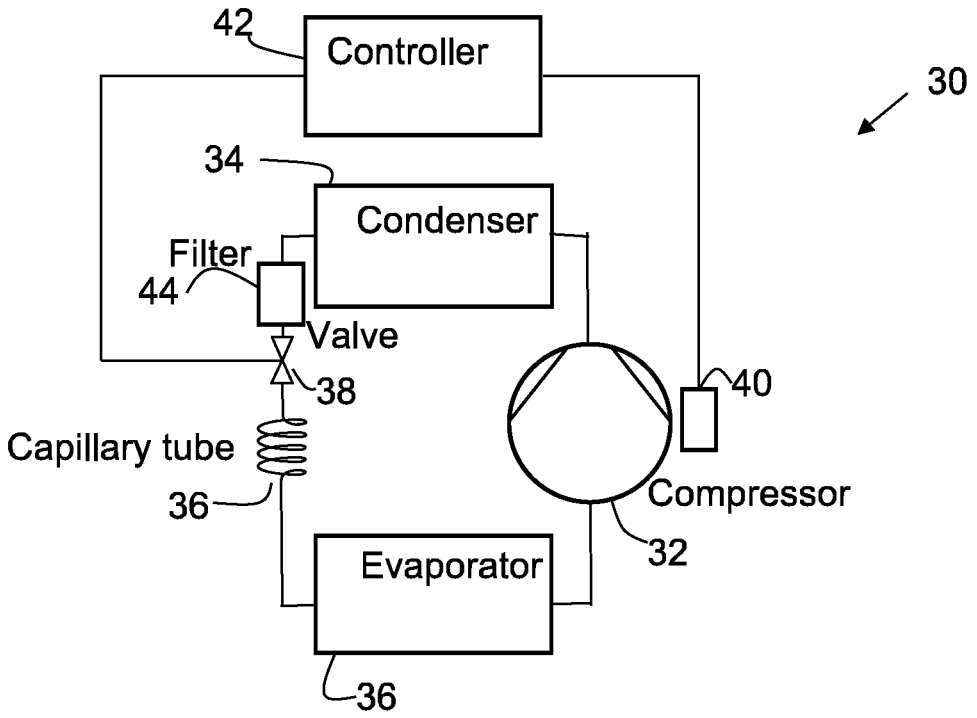
FIG. 2 illustrates a first cooling system configuration of a refrigerator apparatus or a similar device.

In FIG. 2, a cooling system 30 for a refrigerator apparatus is illustrated. The refrigerator apparatus can be any cooling device. In particular the refrigerator apparatus can be a refrigerator or a freezer or a combined refrigerator/freezer for example as described above in conjunction with FIG. 1*b*. The cooling system 30 comprises a compressor 32, a condenser 34 and an evaporator 36. The cooling system 30 also comprises a valve 38, a switch 40 and a controller 42. The cooling system 30 also comprises a capillary tube 46 (or a similar device such as an expansion valve). The cooling system 40 may typically also comprise a filter 44 and may also comprise other components not shown in FIG. 2.

The compressor 32 drives a refrigerant in a cycle whereby the condenser 34 becomes hot and the evaporator 36 becomes cold. In order to reduce energy loss that can occur when the compressor is turned off as a result of hot refrigerant migrating from the hot condenser to the cold evaporator the valve 38 can be provided in the path from the condenser 34 to the evaporator 36. The valve 38 operates to be closed when the compressor is in an off-phase thereby preventing the refrigerant from migrating from the condenser to the evaporator. When the compressor is in an on-phase the valve is open thereby allowing the refrigerant to circulate in the refrigerator system 30. The opening and closing of the valve 38 can be controlled by the controller 42. The controller 42 can also be adapted to control an ON/OFF switch 40 of the compressor 32 whereby the compressor 32 is turned on and off.

Figure 3:
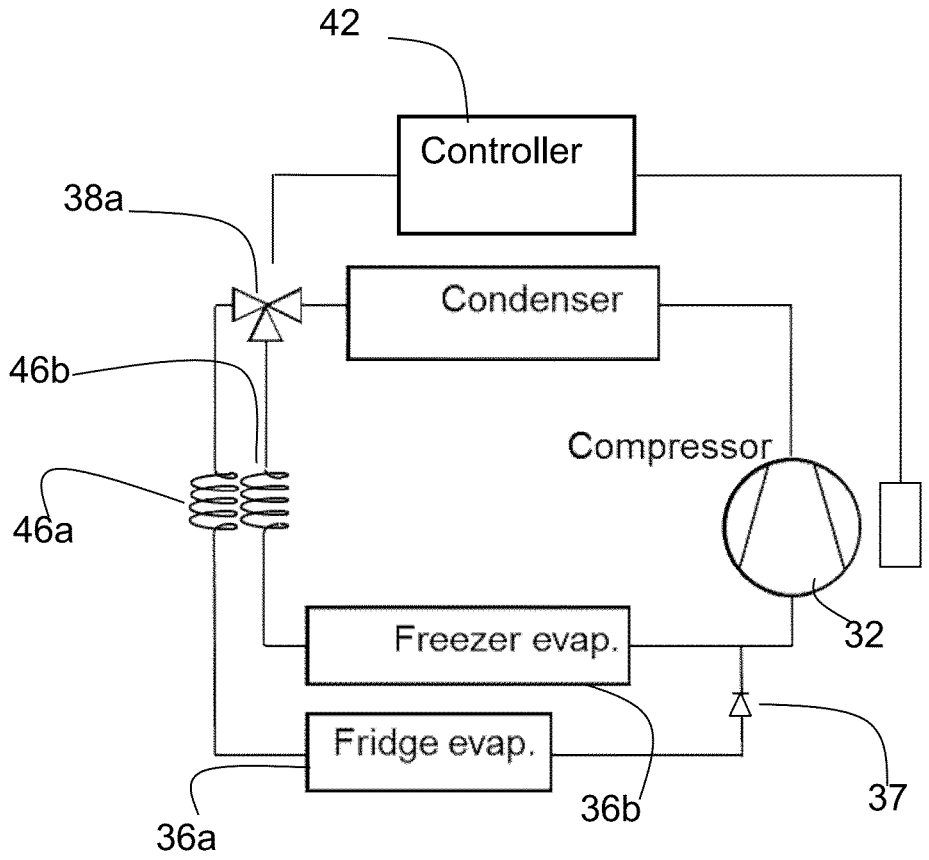
FIG. 3 illustrates a second cooling system configuration of a refrigerator apparatus or a similar device.

In FIG. 3, another configuration of a cooling system is depicted. The cooling system depicted in FIG. 3 essentially comprises the same components as the cooling circuit in FIG. 2, and references to such identical components are omitted. The cooling system in FIG. 3 comprises two evaporators 36*a* and 36*b* provided in parallel. The controller is here configured to either close the valve or open the valve such that the refrigerant circulated in the cooling circuit circulates through only one of the evaporators 36*a* or 36*b*. The evaporator 36*a* can for example be an evaporator for cooling the refrigerator cabinet of a combined refrigerator/freezer and the evaporator 36*b* can for example be an evaporator for cooling the freezer cabinet of a combined refrigerator/freezer. This is obtained by controlling a three-way valve 38*a*, that can be set in a closed position, an open position allowing the refrigerant to circulate through the evaporator 36*a* or an open position allowing the refrigerant to circulate through the evaporator 36*b*. Each of the evaporators 36*a* and 36*b* is associated with a respective capillary tube 46*a* and 46*b*, respectively. The capillary tubes 46*a* and 46*b* are arranged in series with the respective evaporators 36*a* and 36*b* downstream the valve 38*a*. A one-way/check valve 37 can further be provided downstream of the evaporator 36*b*.

Figure 4:
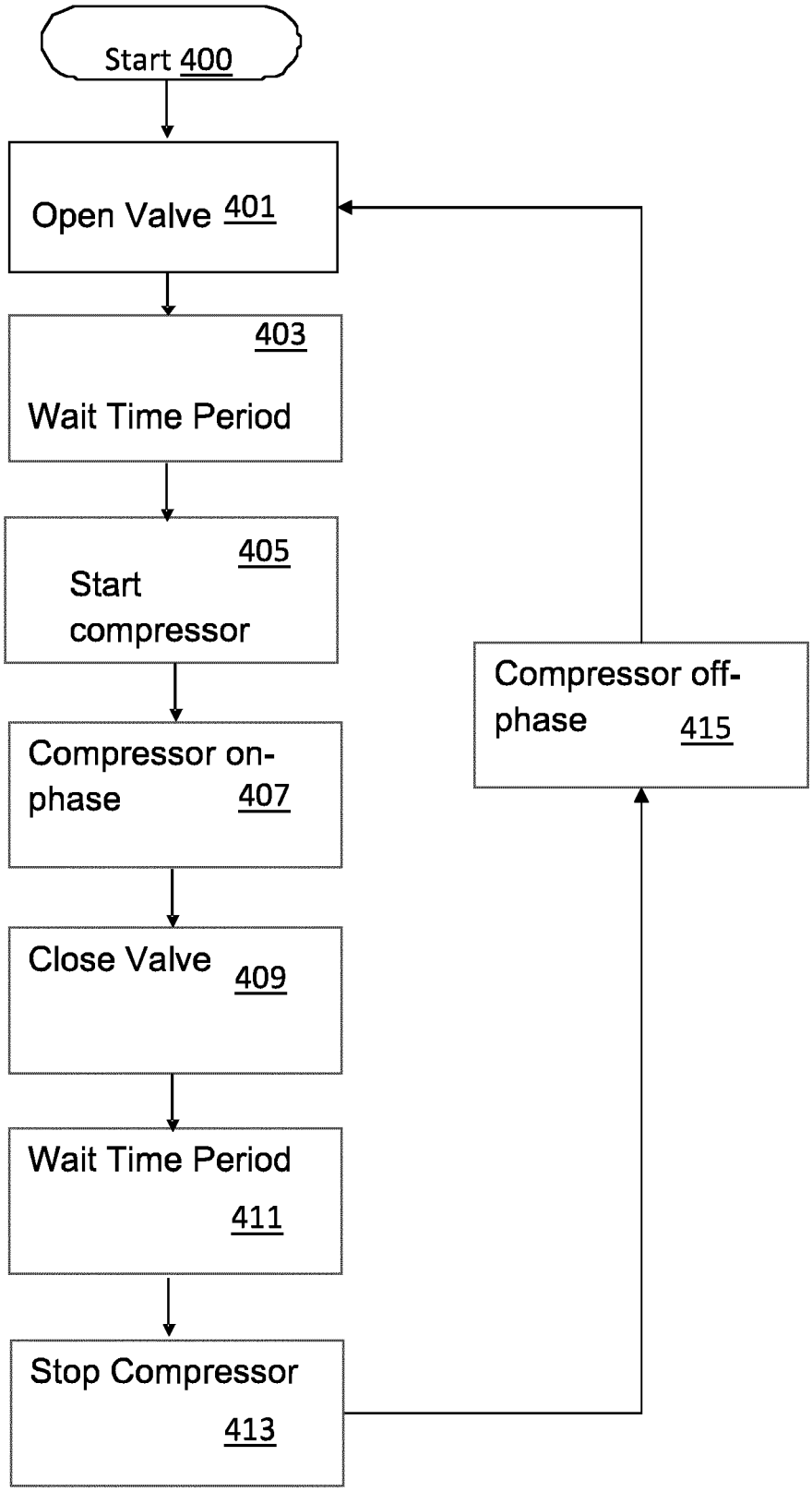
FIG. 4 is a flow chart illustrating some steps performed when controlling a cooling system.

In FIG. 4 an exemplary control procedure for controlling the valve 38 (or 38*a*) to an open or closed state are depicted. The exemplary embodiment of FIG. 4 assumes that there are two evaporators, one refrigerator evaporator and one freezer evaporator associated with a refrigerator compartment and a freezer compartment, respectively. However, it is also envisaged that there can be only one evaporator or additional evaporators and or only one compartment or more than two compartments. When a parameter related to the evaporator (s) or different refrigerator/freezer compartments is used in the control, the system can be controlled in accordance with the number of evaporators/compartments and the present disclosure is not limited to the particular configuration assumed in the following description. In a cooling system with multiple evaporators, it can be particularly advantageous to close the valve before the compressor is switched to an off-phase. This is because the evaporator through which the refrigerant flows can be emptied before the next compressor cycle starts. The refrigerant from the emptied evaporator can then be used in the other evaporator in the next compressor cycle, which works to improve the energy efficiency of the cooling system.

First, the procedure starts in a step 400. In the start step 400, the compressor 32 is switched off and the valve 38 is closed. Next in a step 401, the valve 38 is opened to prepare for a compressor start. After the valve 38 is opened in step 401, a time period is waited in a step 403. The time period in step 403 can be set to minimize energy losses resulting from non-optimal fluid mass flow through the capillary tube 46. The preopening time is varied for different situations to optimize the energy consumption and/or cooling power.

The parameters used for controlling the preopening time is in accordance with embodiments of the invention be one or many of an ambient temperature, a condenser temperature, the refrigerator temperature, the refrigerator evaporator temperature, the refrigerator set point temperature. In particular it has been discovered that the ambient temperature can be used to improve the energy efficiency of the cooling system. By using the ambient temperature as a parameter to set the pre-opening time together with one or more additional external parameters even further energy savings can be accomplished in that the pre-opening time can be even better optimized. While it is preferred to use the ambient temperature as an external parameter, it is also envisaged that the ambient temperature is not used and that the cooling system is controlled based on one or more other external parameters.

Depending on the parameters used for setting the pre-opening time the time can be set according to the following in an exemplary implementation. Starting from a pre-determined initial value on the pre-opening time, and some pre-determined standard values for the parameter values obtained by the controller, the controller can adjust the pre-opening time such that:

an ambient temperature above the standard temperature or a condenser temperature above the standard condenser temperature makes the controller set a shorter preopening time, or vice versa.

Similarly, a higher refrigerator temperature than the standard refrigerator temperature or a higher refrigerator evaporator temperature than the standard refrigerator evaporator temperature or a higher refrigerator set point temperature than the standard refrigerator set point temperature makes the controller set a longer preopening time, or vice versa.

In other words, the opening of the valve is set to a variable time period before the compressor is switched to an on-phase; where the variable time period is set in response to one or many external parameter(s) obtained by the controller.

Next, in a step 405, the compressor 32 is started. The compressor 32 then runs for the duration of the compressor on-phase in a step 407. Before the compressor is switched off the valve 38 is closed in a step 409. Then there is a waiting period from when the valve 38 is closed until the compressor is switched off in a step 411. The waiting time in step 411 can in some embodiments be set in response to one or many external parameters.

The parameters to use for controlling the waiting period, also referred to as pump down time, can be one or many of:

ambient temperature, condenser temperature, freezer temperature, freezer evaporator temperature, freezer set point, compressor speed at a time before closing the valve, compressor speed at closing of the valve (i.e., the compressor speed when the valve is in a closed state). In particular it has been discovered that the ambient temperature can be used to improve the energy efficiency of the cooling system. By using the ambient temperature as a parameter to set the waiting time together with one or more additional external parameters even further energy savings can be accomplished in that the pre-opening time can be even better optimized. While it is preferred to use the ambient temperature as an external parameter, it is also envisaged that the ambient temperature is not used and that the cooling system is controlled based on one or more other external parameters.

Depending on the parameters used for setting the closing time of the valve, the time can be set according to the following in an exemplary implementation. Starting from a pre-determined initial value on the closing time, and some pre-determined standard values for the parameter values obtained by the controller, the controller can adjust the closing time such that:

When the ambient temperature is higher than a standard ambient temperature or the condenser temperature is higher than a standard condenser temperature, the closing time is increased (i.e., the valve is closed longer before the compressor is switched to an off-phase) and/or a higher compressor speed is initiated during the time when the valve is closed until the compressor is switched to an off-phase, and vice versa.

Further, when a freezer temperature is higher than a standard freezer temperature or a freezer evaporator temperature is higher than a standard freezer evaporator temperature or a freezer set point is higher than a standard freezer set point the closing time is decreased, and vice versa.

Further, when a compressor speed lower than a standard compressor speed, the compressor speed is increased a time before closing the valve, and vice versa.

In accordance with some embodiments, the compressor speed can be used to determine the duration of the waiting period (pump down time) in step 411. The waiting period can be set to be shorter the higher the compressor speed, and vice versa. also referred to as pump down time. Further, the estimated (predicted) compressor speed for the up-coming cooling cycle can be used to determine duration of the waiting period. The higher predicted compressor speed for the upcoming cooling cycle the shorter the waiting period can be set, and vice versa. Thus, the existing and or predicted compressor speed can be used by the cooling system to set the waiting time (pump down time).

A new compressor cycle can then start by returning to step 401.

However, when starting the compressor again it can happen that because there is no refrigerant flow during the compressor off time there will be a pressure difference between high pressure and low-pressure side of the compressor at compressor start. This pressure difference will make it harder for the compressor to start and can in worst case lead to failed compressor start or sometimes an increased compressor start noise. A single speed compressor can normally not start at all with these pressure differences, but even variable speed compressors can suffer from problems at start. Whether the compressor will start smoothly at a pressure difference, depends on the position of the compressor piston at start. Some start positions of the piston require higher start torque than others, and high start torque is many times related to start problems. The start position is typically a random, or at least not controlled, result of the last compressor stop situation.

By letting the controller control/move the compressor piston backwards (against the normal direction of movement during operation) a short distance and/or for a short time before the start of moving it in the normal direction an improved starting of the compressor can be obtained. The purpose with this is to decrease or remove the risk of compressor start failures. This can be particularly useful in a system operating with double evaporators such as one refrigerator evaporator and one freezer evaporator. By letting the controller drive the piston backwards with a predetermined force and or during a predetermined time an improved starting position can be obtained. Because the piston, when in a bad starting condition will be easy to move this will move the piston to a better starting position. If the piston is in a good starting position a significantly higher force is required to move the piston. Hereby, when a force is applied to the piston to move it backwards, the result will be a position from which the compressor can start. In other words, on average, the starting position will be significantly improved and in particular any situation when it is impossible or really bad to start the compressor can be avoided.

In the exemplary procedures above the controller 42 is configured to use both a varying time off-set, i.e., a waiting time period, between the opening of the valve 38 and the start of the compressor 32 as well as a varying time offset, i.e., a waiting time period, between the closing of the valve 38 and the stop of the compressor 32. However, it is envisaged that in some embodiments only one of the two time off-sets is variable and the other is fixed. Also, the combination of the different parameters can be made different for different implementations.

Figure 5:
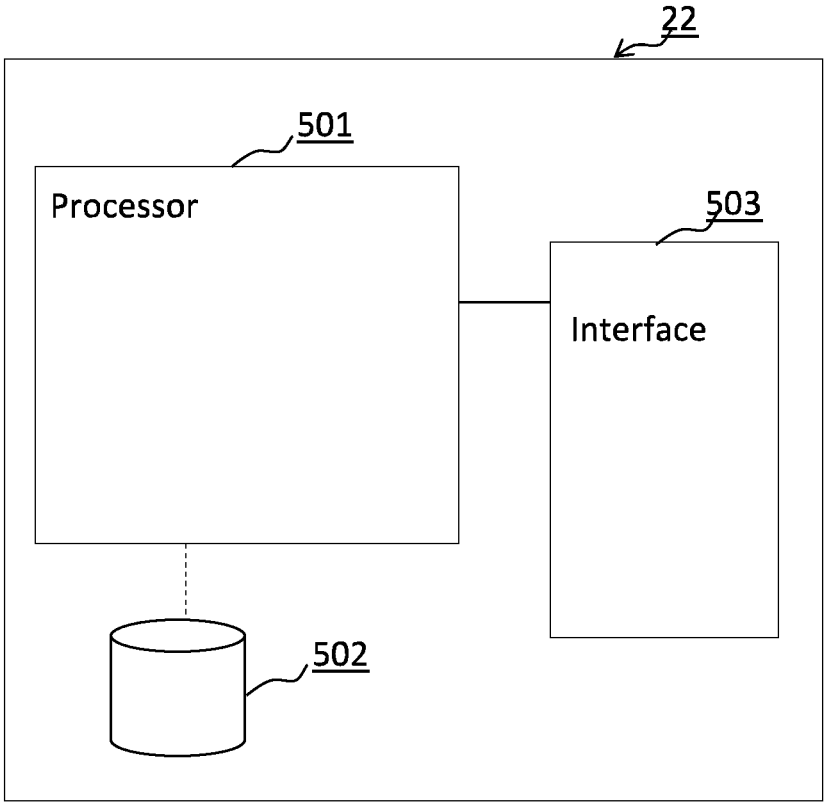
FIG. 5 illustrates a controller.

Further, the controller 42 can be implemented using suitable hardware and or software. An exemplary controller is depicted in FIG. 5. The hardware can comprise one or many processors 501 that can be arranged to execute software stored in a readable storage media 502. The processor (s) can be implemented by a single dedicated processor, by a single shared processor, or by a plurality of individual processors, some of which may be shared or distributed. Moreover, a processor or may include, without limitation, digital signal processor (DSP) hardware, ASIC hardware, read only memory (ROM), random access memory (RAM), and/or other storage media. The processor 42 is adapted to send and receive signals from other entities such as the switch 40 and the valve 38 and different external sensors or other units using an interface 503. The controller 42 can in particular be configured to implement the control procedures as described herein.

Using the methods and apparatuses as set out herein provides a more efficient refrigerator system that can be used in a freezer/refrigerator.

The invention claimed is:

1. A cooling system (30) comprising a compressor (32), a condenser (34) and an evaporator (36) wherein a refrigerant is circulated, the cooling system further comprising a valve (38) interconnected in the flow of the refrigerant from the condenser to the evaporator, the valve being configured to enter a first, open, state when the compressor is in an on-phase and to enter a second, closed, state when the compressor is in an off state by a controller (42), wherein the controller is adapted to control the valve to operate in accordance with at least one of:

opening the valve a first variable time period before the compressor is switched to an on-phase; where the first variable time period is set in response to an external parameter obtained by the controller, and/or closing the valve a second variable time period before the compressor is switched to an off-phase, where the second variable time period is set in response to an external parameter obtained by the controller, wherein the external parameter comprises at least one of: an ambient temperature, a condenser temperature, a refrigerator temperature, a refrigerator evaporator temperature, and a refrigerator set point temperature.

2. The cooling system according to claim 1, where the controller is adapted to, when the compressor is in an off state, move a piston of the compressor backwards against the normal direction of operation of the piston.

3. The cooling system according to claim 2, wherein the controller is adapted to move the piston with a pre-determined force and/or during a predetermined time.

4. The cooling system according to claim 1, wherein the controller is adapted to, when the ambient temperature above a standard temperature, set a shorter preopening time for the valve.

5. The cooling system according to claim 1, wherein the controller is adapted to, when the ambient temperature is higher than a standard ambient temperature, set increase the closing time such that the valve is closed longer before the compressor is switched to an off-phase.

6. The cooling system according to claim 1, wherein the cooling system comprises at least a first evaporator (36*a*) and a second evaporator (36*b*) and wherein the first evaporator is connected in parallel with the second evaporator.

7. The cooling system according to claim 1, wherein the cooling system comprises a compressor driven at a variable speed, and wherein the speed of the compressor is varied based on the external parameter.

8. A refrigerator (10) comprising a cooling system according to claim 1.

9. A cooling system (30) comprising a compressor (32), a condenser (34) and an evaporator (36) wherein a refrigerant is circulated, the cooling system further comprising a valve (38) interconnected in the flow of the refrigerant from the condenser to the evaporator, the valve being configured to enter a first, open, state when the compressor is in an on-phase and to enter a second, closed, state when the compressor is in an off state by a controller (42), wherein the controller is adapted to control the valve to operate in accordance with at least one of:

opening the valve a first variable time period before the compressor is switched to an on-phase; where the first variable time period is set in response to an external parameter obtained by the controller, and/or closing the valve a second variable time period before the compressor is switched to an off-phase, where the second variable time period is set in response to an external parameter obtained by the controller, where the controller is adapted to, when the compressor is in an off state, move a piston of the compressor backwards against the normal direction of operation of the piston.

10. A cooling system (30) comprising a compressor (32), a condenser (34) and an evaporator (36) wherein a refrigerant is circulated, the cooling system further comprising a valve (38) interconnected in the flow of the refrigerant from the condenser to the evaporator, the valve being configured to enter a first, open, state when the compressor is in an on-phase and to enter a second, closed, state when the compressor is in an off state by a controller (42), wherein the controller is adapted to control the valve to operate in accordance with at least one of:

opening the valve a first variable time period before the compressor is switched to an on-phase; where the first variable time period is set in response to an external parameter obtained by the controller, and/or closing the valve a second variable time period before the compressor is switched to an off-phase, where the second variable time period is set in response to an external parameter obtained by the controller, where the controller is adapted to, when the compressor is in an off state, move a piston of the compressor backwards against the normal direction of operation of the piston, and wherein the controller is adapted to move the piston with a pre-determined force and/or during a predetermined time.

* * * * *